United States Patent [19]

Bruckner

[11] 4,217,825

[45] Aug. 19, 1980

[54] ASSEMBLY FOR CLAMPING AND TIGHTENING A BLANKET OVER A BLANKET CYLINDER IN A PRINTING PRESS

[75] Inventor: Carl H. Bruckner, Bensheim-Auerbach, Fed. Rep. of Germany

[73] Assignee: M.A.N.-Roland Druckmaschinen Aktiengesellschaft, Fed. Rep. of Germany

[21] Appl. No.: 49,159

[22] Filed: Jun. 18, 1979

[30] Foreign Application Priority Data

Jun. 30, 1978 [DE] Fed. Rep. of Germany ..... 2828747

[51] Int. Cl.[3] ..... B41F 27/06; B41F 7/22

[52] U.S. Cl. ..... 101/415.1; 51/368

[58] Field of Search ..... 101/415.1, 378, 125, 101/126, 131, 131.5, 132, 132.5, 133, 407, 418; 51/368, 367, 364; 346/138; 358/291; 242/74; 355/3 DR

[56] References Cited

U.S. PATENT DOCUMENTS

| | | | |
|---|---|---|---|
| 3,276,364 | 10/1966 | Langer | 101/415.1 |
| 3,584,580 | 6/1971 | Schulz | 101/415.1 |
| 3,818,651 | 6/1974 | Eells | 51/358 |

FOREIGN PATENT DOCUMENTS

| | | | |
|---|---|---|---|
| 756867 | 9/1956 | United Kingdom | 101/415.1 |
| 1192209 | 5/1970 | United Kingdom | 101/415.1 |

*Primary Examiner*—J. Reed Fisher

*Attorney, Agent, or Firm*—Leydig, Voit, Osann, Mayer & Holt, Ltd.

[57] ABSTRACT

A blanket cylinder construction for clamping and tightening a flexible blanket on a blanket cylinder in a printing press which includes a longitudinal shaft recessed under a narrow axial slot in the cylinder surface. The shaft has a first clamping bar extending flatly along one side forming a pocket along one of its edges presenting a roughened surface for receiving and engaging one end of the blanket as well as a second clamping bar extending flatly along the opposite side of the shaft forming a pocket having a roughened surface for receiving and engaging the opposite end of the blanket. The first clamping bar has a set of clamping screws for clamping the bar to the shaft actuated by a tool inserted through the slot. The second clamping bar has a set of clamping screws for clamping the bar to the shaft and which penetrate both the first clamping bar and the shaft so that both sets of screws can be operated by a tool inserted through the slot when the first clamping bar is rocked into an aligned tool-accepting position with respect to the slot. After the ends of the blanket have been clamped in the pockets the shaft is rocked in a direction to wind up the ends of the blanket thereon and the blanket is locked in a blanket-tensioning condition.

3 Claims, 10 Drawing Figures

(INSERT INTO A)

(ROTATE 90° CW TIGHTEN A)

ROTATE ADD'L 90° CW. (INSERT INTO B)

(ROTATE 90° CCW. TIGHTEN B)

(WIND TO TIGHTEN BLANKET)

ASSEMBLY FOR CLAMPING AND TIGHTENING A BLANKET OVER A BLANKET CYLINDER IN A PRINTING PRESS

It is desirable, particularly in lithographic presses having a small format, to minimize the width of the slot through which the ends of the blanket are led into the cylinder.

Langer U.S. Pat. No. 3,276,364 which issued Oct. 4, 1966 describes a reel shaft for a blanket cylinder for receiving the ends of the blanket and which is rockable for winding up the ends of the blanket thereon for holding the blanket in tension. The advantage of the Langer arrangement is that it permits use of an extremely narrow slot in the blanket cylinder. However, the disadvantage is that to use the construction the straight ends of the blanket must first be fitted with durable and firmly secured reinforcing bars. Fitting each blanket in this way involves considerable time and expense. Thus it has been the practice in the art to employ clamping arrangements capable of clamping the unfitted ends of the blanket and the use of a wide slot for obtaining access to the clamping means has been tolerated as a necessary evil.

It is, accordingly, an object of the present invention to provide an assembly for clamping and tightening a blanket on a blanket cylinder which is capable of accepting and clamping the unfitted ends of a flexible blanket but which permits manipulation of the clamping means through a slot of extremely narrow width.

It is a more specific object to provide an assembly for clamping and tightening a blanket in which first and second clamping bars are provided on opposite sides of the clamping shaft, or spindle, and in which both clamping bars are operable by means of screws accessible from the same side of the shaft, thereby permitting a novel installation procedure in which the shaft is rocked between successive blanket-accepting and tool-accepting positions.

It is, moreover, an object to provide a blanket cylinder construction which includes a clamping shaft having a set of clamping bars and which provides the benefits mentioned above but which is in addition simple, easily operated, and highly economical.

Other objects and advantages of the invention will become apparent upon reading the attached description and in reference to the drawings in which.

Figure 6A:
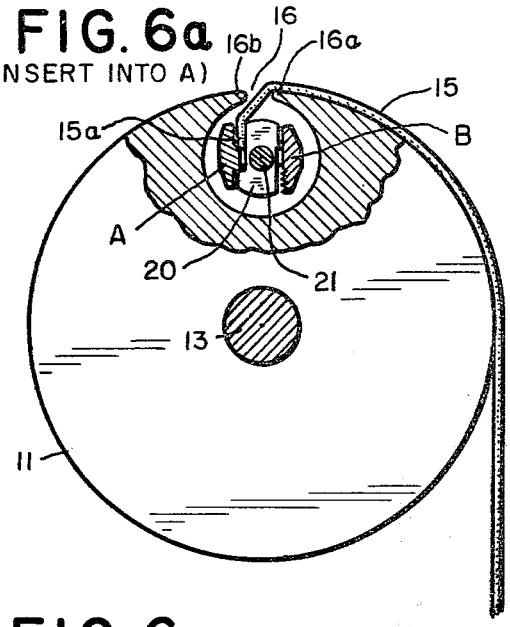
Figure 6B:
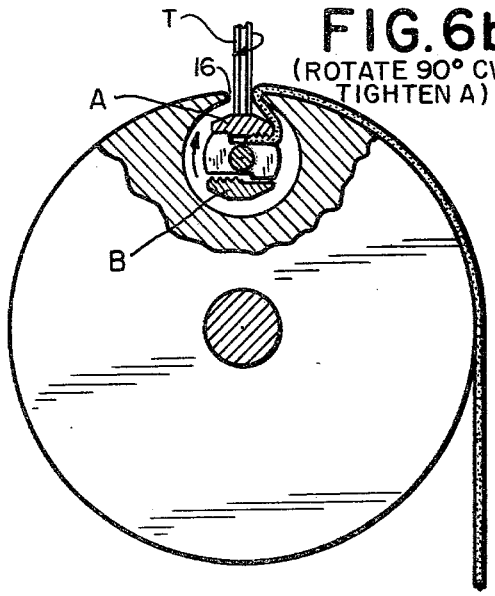

FIGS. 6*a*-6*e* are a set of stop motion views showing a typical installation cycle, with FIGS. 6*a* and 6*b* showing installation and clamping of one end of the blanket, 6*c* and 6*d* showing installation and clamping of the other end of the blanket, and 6*e* showing the winding up of the blanket on the clamping shaft.

While the invention has been described in connection with a preferred embodiment, it will be understood that I do not intend to be limited to the particular embodiment shown but intend, on the contrary, to cover the various alternative and equivalent forms of the invention included within the spirit and scope of the appended claims.

Figure 1:
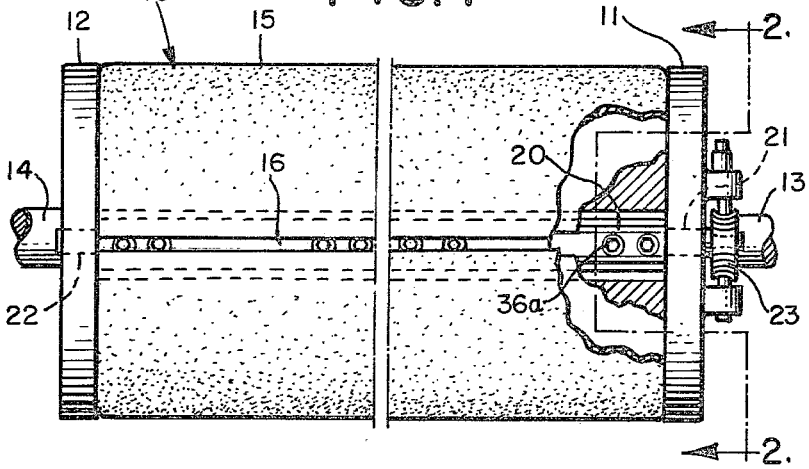
FIG. 1 is a plan view of a blanket cylinder constructed in accordance with the present invention with a portion broken away to reveal the undercut recess and the longitudinal clamping shaft.
Figure 2:
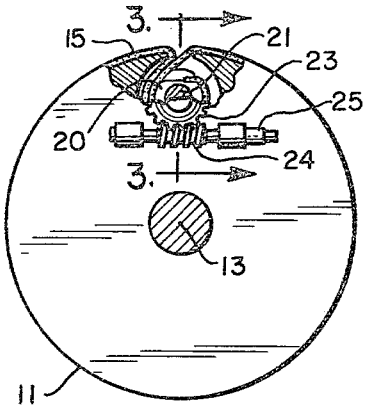
FIG. 2 is an end view of the cylinder of FIG. 9 showing the worm and worm gear for rocking the shaft.
Figure 3:
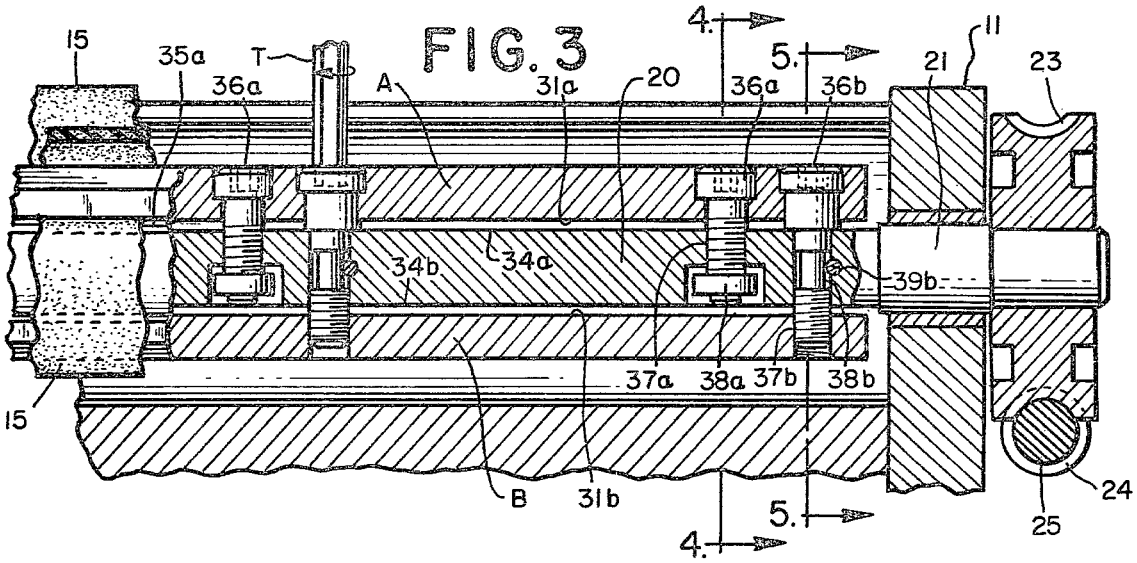
FIG. 3 is a fragmentary elevational view looking along line 3—3 in FIG. 2 and showing one end of the shaft in cross section.
Figure 4:
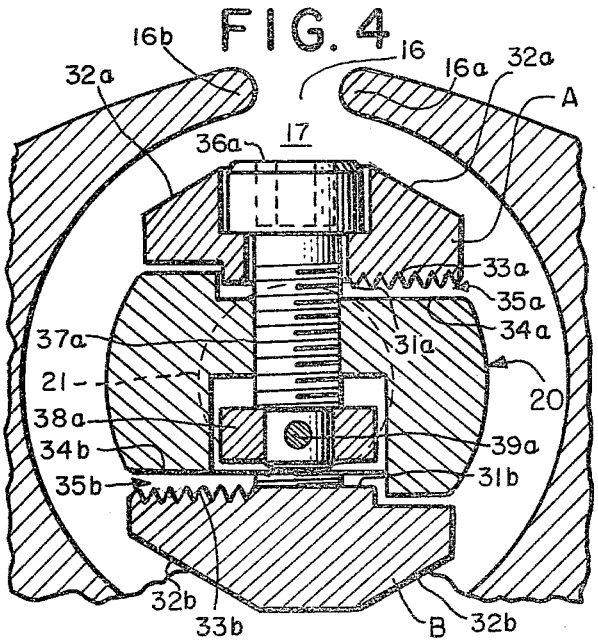
FIG. 4 is a fragmentary cross sectional view taken along line 4—4 in FIG. 3.
Figure 5:
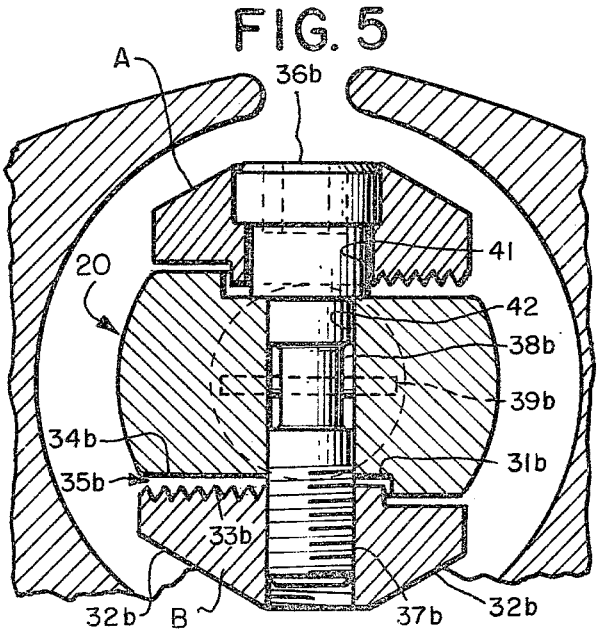
FIG. 5 is a similar view taken along line 5—5 in FIG. 3.

Turning now to the drawings there is shown, in FIGS. 1 and 2, a typical blanket cylinder 10 constructed in accordance with the invention having ends 11, 12 and stubshafts 13, 14. On the surface of the cylinder is a blanket 15, the ends of which pass downwardly into a longitudinally extending slot 16 having edges 16*a*, 16*b*.

Centered with respect to the slot is a longitudinally extending recess, or clearance space 17 of cylindrical shape.

Mounted within the recess 17 is a clamping shaft, or spindle, 20 having stubshafts 21, 22 at its ends journaled in the end members 11, 12, respectively, of the cylinder. Secured to the stubshaft 21 is a worm wheel 23 driven by a worm 24 on a shaft 25, the shaft being fitted for engagement of a convenient turning tool.

In accordance with the present invention the shaft 20 is fitted with a first clamping bar extending flatly along one side thereof and forming a pocket having a roughened surface for receiving and engaging one end of the blanket and a second clamping bar extending flatly along the opposite side of the shaft and forming a second, diametrically arranged, pocket having a roughened surface for receiving and engaging the opposite end of the blanket. The first clamping bar has a set of clamping screws operable by a tool inserted through the slot when the first clamping bar is rocked to an aligned tool-accepting position and the second clamping bar has a set of clamping screws which penetrate the first clamping bar and the shaft so as to be operable by the tool when the first clamping bar is rocked into the same tool-accepting position.

In order to distinguish the two clamping bars from one another in considering a typical operating sequence in connection with FIGS. 6, the first and second clamping bars have been prominently labeled A and B. Taking first the bar A, it is of generally flattened shape on its undersurface 31*a* and longitudinally chamfered or crowned along its outer surface 32*a*. The under surface is, moreover, roughened by grooving or knurling as indicated at 33*a*. The adjacent side of the shaft is flattened as indicated at 34*a* so that there is defined between the surfaces 33*a*, 34*a* a pocket 35*a* into which the first end of the blanket, indicated at 15*a*, is inserted and clamped. For the purpose of clamping the bar A to the shaft 20 to hold the end of the blanket captive, the bar A is fitted with a series of clamping screws 36*a*. Such clamping screws are of the type generally referred to as allen-head cap screws having a shank 37*a* which is screwed into the shaft 20. For the purpose of preventing total unscrewing of the screws 36*a*, each is fitted with an annular stop member 38*a* held in place by a pin 39*a*.

The second clamping bar, indicated at B, is similarly constructed, having an inner surface or undersurface 31*b*, an outer surface 32*b* and a roughened surface 33*b* cooperating with a flattened surface 34*b* on the shaft to define a blanket-receiving pocket 35*b*.

In carrying out the invention the clamping bar B is clamped by a set of clamping screws 36*b* which face in the same direction as the clamping screws which operate the bar A for access by the clamping tool when the bar A is in an aligned tool-accepting position with respect to the slot. Each clamping screw 36*b* has a shank 37*b*, the tip of which is threaded into the clamping bar B. To prevent complete withdrawal of the clamping screws 36*b*, each has a necked down portion 38*b* at the central portion of its shank and which cooperates with a pin 39*b* which extends in a chordwise direction.

In accordance with one of the important features of the present invention the clamping screws 36*b* extend through freely penetrated clearance holes 41, 42 formed in the clamping bar A and in the shaft, respectively.

The novel mode of installation which this construction permits is illustrated in the stop motion views 6*a*–6*e*. Initially the assembly occupies the condition shown in FIG. 6*a* where the first end 15*a* of the blanket 15 is interposed in the pocket under the clamping bar A in blanket-accepting position, with the remainder of the blanket simply draped outside of the cylinder.

The assembly is then rocked clockwise through an approximate angle of 90 degrees into a tool-accepting position aligned with the slot 16. The tool, which may be in the form of an allen wrench T, is then inserted into the screws 36*a* for successively tightening them so that the clamping bar A is in secure gripping engagement with the first end of the blanket. The roughened surface 33*a* tends to prevent dislodgement of the end of the blanket during the 90 degree rotation.

Figure 6C:
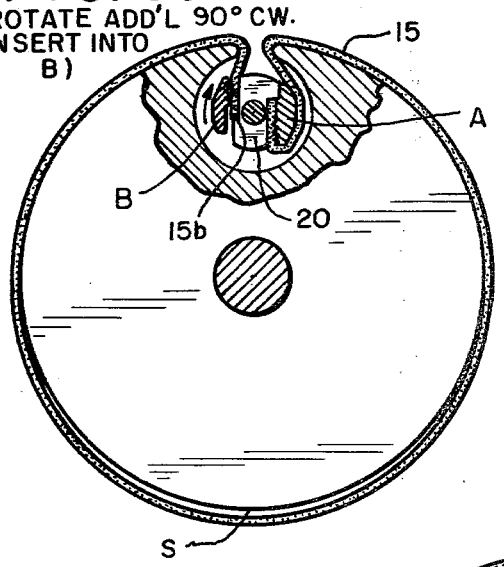

With the turning tool T removed, and as a next step illustrated in FIG. 6*c*, the shaft 20 is turned through an additional angle of approximately 90 degrees in the clockwise direction so that the clamping bar B is in blanket-accepting position. The blanket is wrapped around the cylinder and the second end 15*b* thereof is inserted under the clamping bar B, leaving a certain amount of slack in the blanket as indicated at S.

Figure 6D:
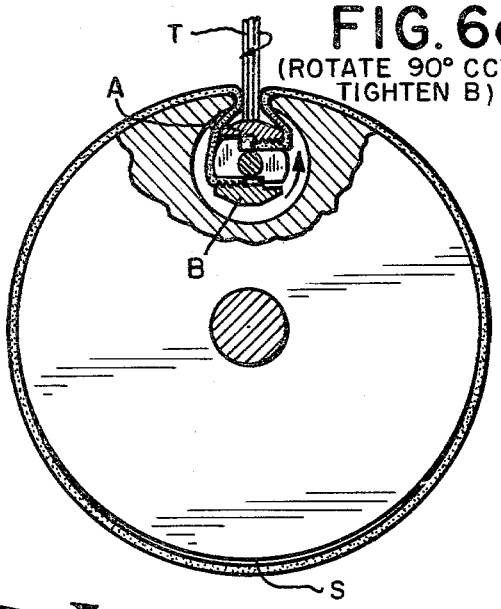

As a next step, illustrated in FIG. 6*d*, the shaft 20 is rotated through an approximately 90 degree angle in the counterclockwise direction so that the first clamping bar A is again rocked into tool-receiving alignment with the slot in the cylinder. In this position the tool T is successively inserted into the clamping screws 36*b*, with the threaded shanks 37*b* of the clamping screws drawing the clamping bar B up tight against the end 15*b* of the blanket.

Figure 6E:
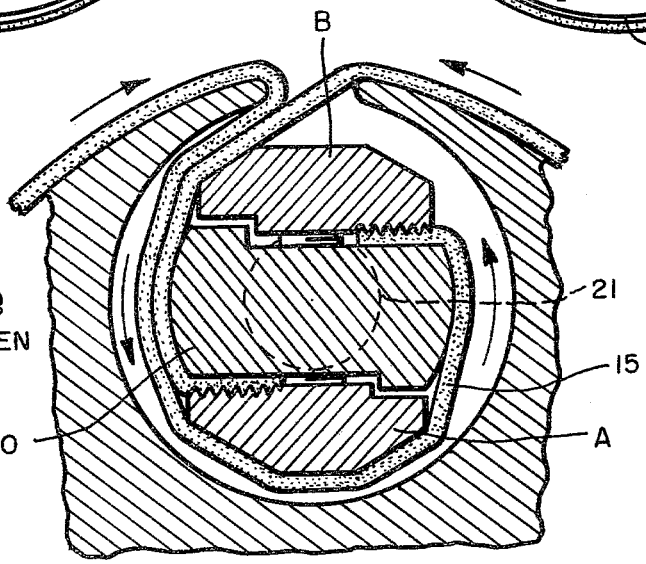

After removal of the tool, the final step is to rotate the shaft additionally, preferably in the counterclockwise direction, as illustrated in FIG. 6*e* which serves to wind up the trapped ends of the blanket about the shaft thereby removing the slack S and tensioning the banket about the surface of the cylinder. Since the worm drive 23–24 for the shaft 20 is inherently irreversible, the drive serves also as an automatic locking means to maintain the shaft in position and the blanket in its tensioned state.

It will be apparent that the above-described construction fully achieves the advantages and objects of the invention. The slot 16 in the surface of the cylinder may be made of minimum constant width, limited only by the thickness of the allen-type turning tool which is employed for tightening purposes. The assembly is highly compact, with the shaft, clamping jaws, and the screws which operate them all being confined within a circle no larger than that usually required for a conventional shaft alone. The clamping is highly secure and easily and quickly accomplished. The construction is inherently economical.

In practicing my invention in its preferred form, illustrated in the drawings, the clamping screws, similarly to a conventional cap screw, have a socketed head and threaded shank. However, one skilled in the art will appreciate that it is not necessary to use screws of conventional type and that threaded studs may be employed, if desired, for clamping purposes without departing from the invention. Thus screw 36*a* may be replaced by a threaded stud which is anchored in the shaft and which has a nut on its outer end occupying the position of the screw head. Similarly screw 36*b* may be replaced by a threaded stud which is anchored in the clamping bar B and which has at its outer end a nut pressing on bar A and which occupies the "head" position. However, use of studs and nuts to replace the clamping screws is not considered a desirable step since an unscrewed nut could form a missile and because of the greater thickness of the tool which might be required to operate a nut as compared to a screw. Conceivably, captive nuts could be employed operable by a tool of limited thickness but such additional steps are beyond the scope of the present invention. It is apparent, in any event, that the term "clamping screw" used herein is not to be limited to the particular type of screw which has been illustrated but includes alternate threaded means, such as a stud and nut combination, provided that such threaded means is operable, for both clamping bars, from the same side of the shaft.

The term "roughened surface" as used herein is intended to mean that at least one of the surfaces of each of the pockets 35*a*, 35*b* is sufficiently roughened, or interrupted, to prevent dislodgement of the received end of the blanket incident to rocking movement of the shaft while the adjacent clamping bar is still in the untightened state.

What I claim is:

1. A blanket cylinder construction for clamping and tightening a flexible blanket having straight ends comprising, in combination, a cylinder body having a narrow axial slot in its surface in centered relation to an undercut longitudinal recess, a longitudinal shaft in such recess journaled at the ends of the cylinder for rocking movement, a first clamping bar extending flatly along one side of the shaft and forming with the shaft a first pocket along one of its edges presenting a first roughened surface for receiving and engaging one end of the blanket when rocked to a first blanket-accepting position, a second clamping bar extending flatly along the opposite side of the shaft and forming with the shaft a second diametrically arranged pocket presenting a second roughened surface for receiving and engaging the opposite end of the blanket when rocked to a second blanket-accepting position, the first clamping bar having a first set of clamping screws for clamping the first clamping bar to the shaft and operable by a tool inserted through the slot when the first clamping bar is rocked into an aligned tool-accepting position with respect to the slot, the second clamping bar having a second set of clamping screws for clamping the second clamping bar to the shaft, the second set of screws penetrating both the first clamping bar and the shaft, the clamping screws all being faced in the same direction so as to be operable from the same direction by the tool inserted through the slot when the first clamping bar is again rocked into alignment with the slot, and means coupled to one of the ends of the shaft for rocking the shaft into its blanket-accepting and tool-accepting positions for finally rocking the shaft in a direction to wind up the ends of the blanket thereon for tensioning the blanket about the cylinder surface, said rocking means including means for locking the shaft in its blanket-tensioning condition.

2. The combination as claimed in claim 1 or claim 3 in which there is associated with each clamping screw a limit stop to prevent such clamping screw from being totally unscrewed and to insure that each screw remains, in its non-clamping state, captive on the shaft.

3. A blanket cylinder construction for clamping and tightening a flexible blanket having straight ends comprising, in combination, a cylinder body having an axial slot in its surface forming a recess, a longitudinal shaft in such recess journaled at the ends of the cylinder for rocking movement, a first clamping bar extending flatly along one side of the shaft and forming with the shaft a first pocket along one of its edges presenting a first roughened surface for receiving and engaging one end of the blanket when in a blanket-accepting position, a second clamping bar extending flatly along the opposite side of the shaft and forming with the shaft a second diametrically arranged pocket presenting a second roughened surface for receiving and engaging the opposite end of the blanket when in a blanket-accepting position, the first clamping bar having a first set of clamping screws for clamping the first clamping bar to the shaft and operable by a tool inserted through the slot, the second clamping bar having a second set of clamping screws for clamping the second clamping bar to the shaft, the second set of screws penetrating both the first clamping bar and the shaft, the clamping screws all being faced in the same direction so as to be operable by the tool from the same side of the shaft, and means coupled to one of the ends of the shaft for rocking the shaft into blanket-accepting position and for finally rocking the shaft in a direction to wind up the ends of the blanket thereon for tensioning the blanket about the cylinder surface, said rocking means including means for locking the shaft in its blanket-tensioning condition.

* * * * *